US011263934B2

(12) United States Patent
Milne

(10) Patent No.: US 11,263,934 B2
(45) Date of Patent: Mar. 1, 2022

(54) PORTABLE RECONFIGURABLE DISPLAY SYSTEM

(71) Applicant: TIMES SQUARE DISTRICT MANAGEMENT ASSOCIATION, INC., New York, NY (US)

(72) Inventor: Victoria Milne, Brooklyn, NY (US)

(73) Assignee: TIMES SQUARE DISTRICT MANAGEMENT ASSOCIATION INC., New York, NY (US)

( * ) Notice: Subject to any disclaimer, the term of this patent is extended or adjusted under 35 U.S.C. 154(b) by 68 days.

(21) Appl. No.: 16/870,255

(22) Filed: May 8, 2020

(65) Prior Publication Data

US 2020/0357314 A1 Nov. 12, 2020

Related U.S. Application Data

(60) Provisional application No. 62/844,923, filed on May 8, 2019.

(51) Int. Cl.
*A47F 5/10* (2006.01)
*A47B 47/00* (2006.01)
(Continued)

(52) U.S. Cl.
CPC ..... *G09F 15/0062* (2013.01); *A47B 47/0075* (2013.01); *A47F 5/083* (2013.01);
(Continued)

(58) Field of Classification Search
CPC ..... G09F 15/0062; G09F 7/22; G09F 1/10; G09F 7/18; G09F 7/02; G09F 7/08; G09F 7/06; A47F 5/108; A47F 2005/0075; A47F 5/10; A47F 5/101; A47F 5/105; A47F 5/0807; A47F 5/0815; A47F 5/0823;
(Continued)

(56) References Cited

U.S. PATENT DOCUMENTS 2,142,547 A * 1/1939 Anderson ..... A47F 11/00 40/539
3,243,047 A * 3/1966 Witteborg ..... A47F 7/148 211/41.1
(Continued)

OTHER PUBLICATIONS

Almond 3 Sided Revolving Pegboard Tower Floor Display Metal Base 16"W×60"H; https://www.amazon.com/Revolving-Pegboard-Tower-Floor-Display/dp/B073WFVQM8; May 2, 2019; pp. 1-4.

*Primary Examiner* — Jennifer E. Novosad
(74) *Attorney, Agent, or Firm* — Gottlieb, Rackman & Reisman, PC

(57) ABSTRACT

A display system comprises one or more display elements in the form of hollow geometrically shaped pillars that can be easily assembled, disassembled, and stored. Each display element is comprised of a plurality of side panels that are removably interconnected in an overlapping manner to themselves and a base. Each side panel has a dense arrangement of mounting apertures formed in at least a portion thereof configured to receive and provide support for mounting hardware to which signage and other elements can be connected. Multiple display elements can be ganged together by themselves or with removably shelving to allow for construction of a wide variety of presentation spaces and structures.

19 Claims, 14 Drawing Sheets

(51) Int. Cl.
*G09F 15/00* (2006.01)
*A47F 5/08* (2006.01)
*A47F 5/11* (2006.01)

(52) U.S. Cl.
CPC ..... *A47F 5/10* (2013.01); *A47F 5/101* (2013.01); *A47F 5/108* (2013.01); *A47F 5/116* (2013.01)

(58) Field of Classification Search
CPC ..... A47F 5/083; A47F 5/112; A47F 5/116; A47B 45/00; A47B 47/00; A47B 47/0066; A47B 47/0075
USPC ..... 211/59.1, 85.1; 40/610, 657, 622, 618
See application file for complete search history.

(56) References Cited

U.S. PATENT DOCUMENTS 3,693,807 A * 9/1972 Larson ..... A47F 5/02 211/163
3,756,421 A * 9/1973 Wilkins ..... A47F 5/02 211/163
3,766,675 A * 10/1973 Leigh ..... G09F 15/0068 40/605
3,931,894 A * 1/1976 Murphy ..... A47F 5/00 211/189
4,126,366 A * 11/1978 Handler ..... A47F 5/02 108/152
4,157,760 A * 6/1979 Wilson ..... A47F 7/021 211/85.1
4,353,179 A * 10/1982 Jennings ..... G09F 7/22 40/431
4,379,432 A * 4/1983 Grossman ..... A47F 5/04 108/159
4,428,136 A * 1/1984 Franklin ..... A47F 11/00 211/175
4,586,619 A * 5/1986 Eckert ..... A47F 7/021 16/266
4,657,149 A * 4/1987 Masson ..... A47F 5/105 160/135
4,673,090 A * 6/1987 Crosslen ..... A47F 5/02 16/355
4,718,561 A * 1/1988 Eckert ..... A47F 7/021 211/194
4,723,666 A * 2/1988 Nichols ..... A47F 5/08 211/189
4,815,612 A * 3/1989 Leo, Sr. ..... A47F 5/02 211/189
5,031,683 A * 7/1991 Marvy ..... E01F 9/688 160/351
5,054,624 A * 10/1991 Camp ..... A47F 5/02 211/85.2
5,078,283 A * 1/1992 Wilson ..... A47F 5/101 160/135
D328,538 S * 8/1992 Berger ..... D6/682.4
5,257,703 A * 11/1993 Ascik ..... A47F 7/021 211/166
5,267,656 A * 12/1993 Nichols ..... A47F 5/04 211/163
D370,367 S * 6/1996 Gassier ..... D6/676
5,620,104 A * 4/1997 Maglione ..... A47F 5/0815 211/189
5,853,090 A * 12/1998 Brozak, Jr. ..... A47F 5/0846 211/13.1
5,966,857 A * 10/1999 Pettersson ..... G09F 1/06 40/606.12
6,036,311 A * 3/2000 Friedman ..... A47F 5/02 351/158
6,062,402 A * 5/2000 Ford ..... A47F 5/083 211/181.1
6,234,330 B1 * 5/2001 Gray ..... A47F 5/0838 211/103
D445,273 S * 7/2001 Brown ..... D6/712
6,302,285 B1 * 10/2001 Fulle ..... A47F 5/04 211/131.1
6,382,433 B1 * 5/2002 Podergois ..... A47F 5/10 211/195
6,443,316 B1 * 9/2002 Mao ..... A47F 5/0807 211/41.3
6,443,317 B1 * 9/2002 Brozak, Jr. ..... A47F 7/021 211/85.1
6,474,483 B1 * 11/2002 Montoya ..... A47B 47/06 211/149
D500,418 S * 1/2005 Levin ..... D6/680.2
6,905,020 B2 * 6/2005 Chang ..... B25H 3/025 206/349
6,951,291 B2 * 10/2005 Kleanthis ..... G09F 15/00 211/163
7,040,495 B2 * 5/2006 Ascik ..... A47F 3/004 211/189
7,159,350 B2 * 1/2007 L'Hotel ..... A47F 5/112 40/610
7,159,351 B2 * 1/2007 Sparkowski ..... G09F 1/06 40/539
7,287,653 B2 * 10/2007 Rhodes ..... A47B 73/006 211/74
D567,542 S * 4/2008 Lane ..... D6/682.2
7,497,332 B1 * 3/2009 Schwimmer ..... B65D 5/4287 206/600
8,291,631 B2 * 10/2012 Wilder ..... G09F 1/06 40/661.09
8,459,472 B2 * 6/2013 Hofman ..... A47G 25/06 211/106.01
D783,321 S * 4/2017 Levy ..... D6/680.2
10,287,089 B2 * 5/2019 Witwer ..... B65D 71/0092
D924,333 S * 7/2021 Milne ..... D20/43
2002/0000417 A1 * 1/2002 Kidd ..... A47F 7/021 211/85.1
2003/0164346 A1 * 9/2003 Shea ..... A47F 5/0823 211/59.1
2004/0262246 A1 * 12/2004 Martins ..... A47F 5/01 211/59.1
2006/0186063 A1 * 8/2006 Campbell ..... A47F 7/163 211/55
2008/0217269 A1 * 9/2008 Topping ..... A47F 5/0823 211/59.1
2010/0199537 A1 * 8/2010 Ernetoft ..... G09F 1/065 40/607.04
2011/0088300 A1 * 4/2011 Martin Presa ..... G09F 15/0025 40/606.12
2012/0227297 A1 * 9/2012 Kawaguchi ..... G09F 1/06 40/610
2016/0213170 A1 * 7/2016 Pizano ..... A47F 7/08
2017/0011671 A1 * 1/2017 Goldrich ..... G09F 15/0031
2020/0037787 A1 * 2/2020 Pratsch ..... G09F 15/0062
2020/0357314 A1 * 11/2020 Milne ..... A47F 5/105

* cited by examiner

PORTABLE RECONFIGURABLE DISPLAY SYSTEM

CROSS-REFERENCE TO RELATED APPLICATIONS

This application claims priority from U.S. Provisional Application Ser. No. 62/844,923, filed on May 8, 2019, the entire contents of which expressly incorporated by reference. This application is also related to U.S. Design patent application Ser. No. 29/690463 filed on May 8, 2019.

FIELD OF THE INVENTION

The present invention relates to a portable display system and element thereof for supporting signage and forming temporary display and presentation structures.

BACKGROUND

Organizations often need to display signs in otherwise open spaces, such as parks, plazas, malls, and other areas where people congregate. The signs can be for advertisement, information, or even decoration. Likewise, various exhibition and display spaces may need to be installed on a temporary basis, such as a kiosk, stage, dance environment, backdrop holder, space divider, presentation space, entry ways, and similar structures.

Conventional sign display options, such as A-frame signs or panel signs mounted on a T-frame base, are common but have an appearance of being temporary and are generally unattractive. In addition, these structures are generally single purpose such that physical components used, e.g., for displaying signage, are not easily configurable for use in other applications.

There is a need for a display unit for use in supporting signs or other items and where the display unit can be quickly and easily installed and removed from a given location, which is easy to store, and which can be configured in an aesthetically pleasing manner while giving the appearance of a more permanent structure. It is also desirable that the display unit be weather resistant and respond well to high wind situations. It is further desirable for the display unit to be usable as a stand-alone display element and usable as a structural and design element forming part of a larger and easily configurable and modifiable display system that can be adapted to create a variety of temporary installations.

SUMMARY

These and other feature are provided by a display unit comprising a plurality of vertical side panels and a base. Each side panel has a generally planar primary outer surface, a top edge, a bottom edge, a first side edge, a second side edge parallel to the first side edge. A transition region adjacent the second side edge is curved about an axis parallel to the second side edge. The side panels are arranged to form a closed geometric shape, such as a triangle when three side panels are used. The curved transition region of each side panel wraps around the first side edge of an adjacent side panel and provides a smooth transition between the sides. The side panels are removably affixed to each other and also removably attached at their bottom edges to a base. The plurality of vertical side panels when decoupled from each other and the base can be stacked in a substantially flat arrangement to allow for easy storage and transportation.

Each side panel has a primary outer surface with a plurality of mounting apertures formed therein. The mounting apertures can be densely packed to reduce the overall surface area of the side panel enough to increase stability by reducing wind resistance. The mounting apertures are configured to receive fasteners for affixing signage to the display structure. The mounting apertures can be formed in only a portion of each side panel, such as an upper portion while a lower portion of the side panel is mounting aperture free and forms a substantially solid surface.

Two or more display units can be ganged together in a variety of configuration to provide an expandable and easily configurable temporary exhibition area, stage, and other types of presentation areas. Pairs of display units can also be joined to each other by one or more removable shelves that can be attached in a horizontal, vertical, or angled position between display units to allow for easy construction and disassembly of a wide variety of presentation spaces, commercial kiosks, and structures.

DESCRIPTION OF THE DRAWINGS

Further features and advantages of the invention, as well as structure and operation of various implementations of the invention, are disclosed in detail below with references to the accompanying drawings in which.

DETAILED DESCRIPTION

Figure 1A:
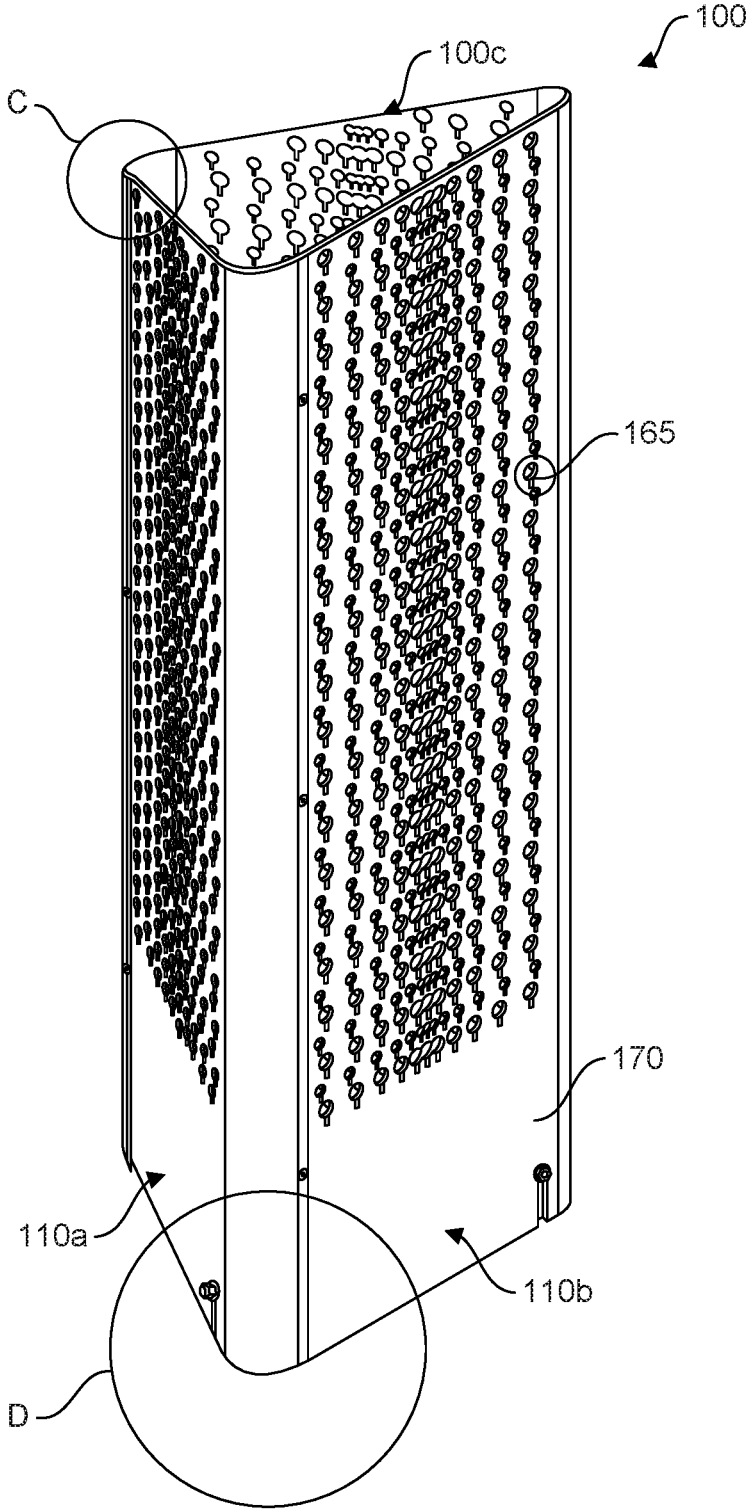
FIGS. 1A-1E illustrate a display unit according an embodiment.
Figure 1B:
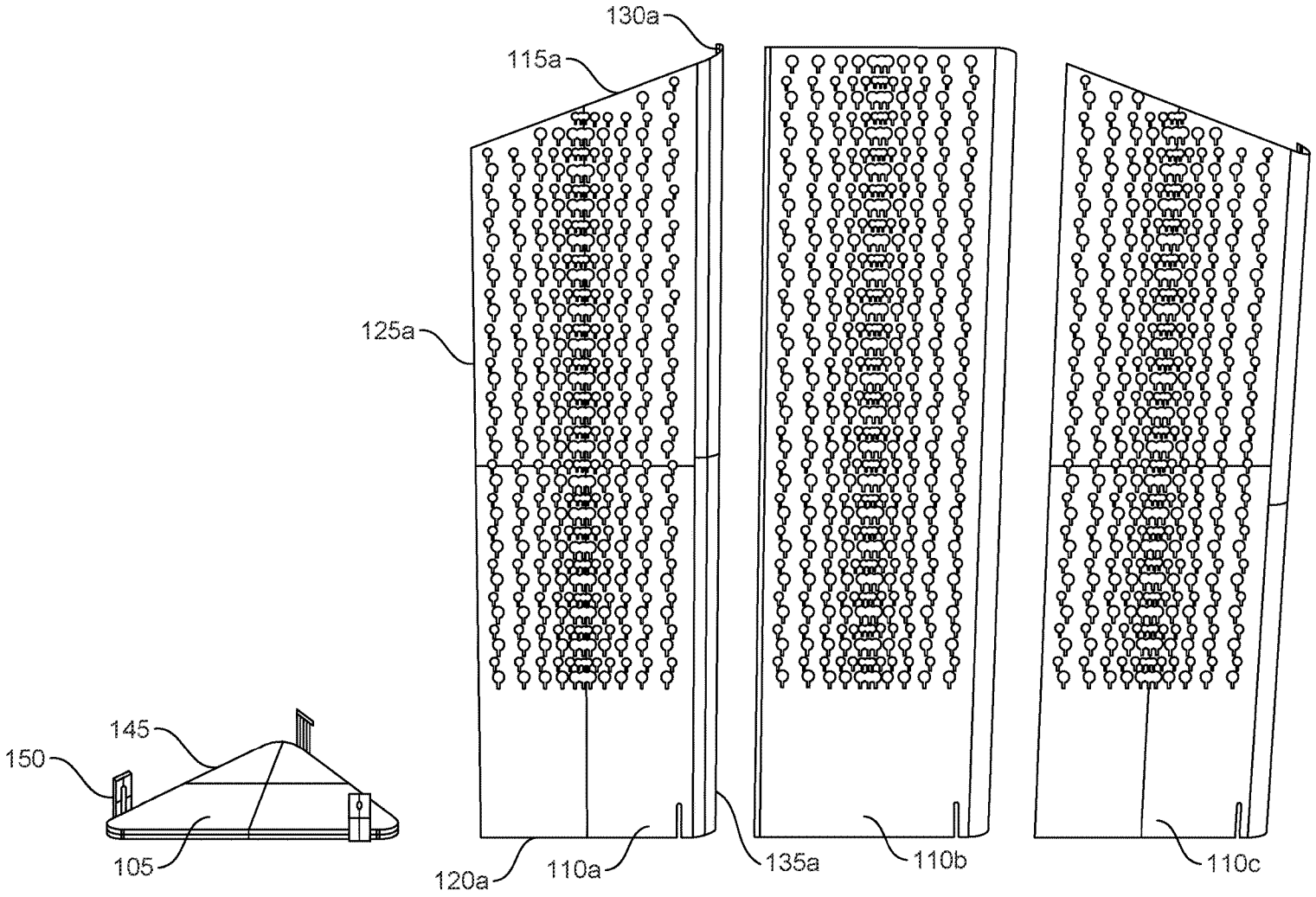
Figure 1C:
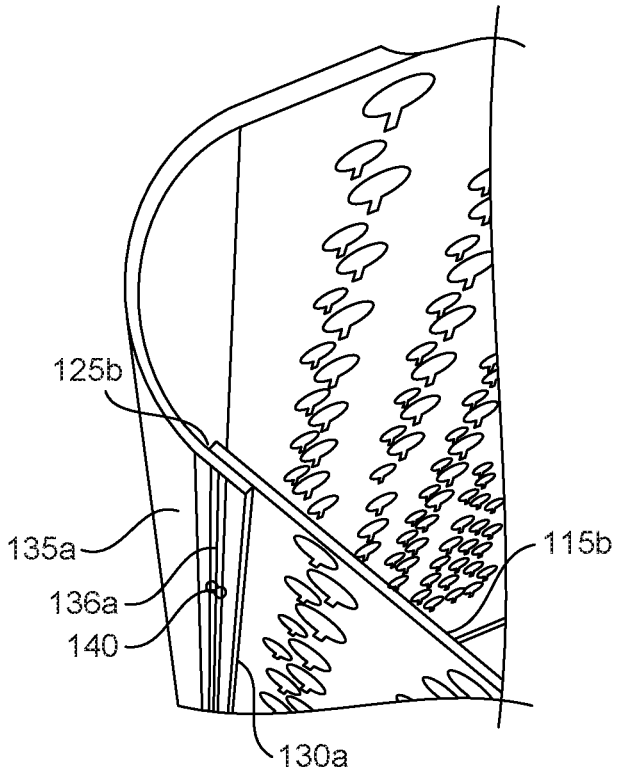
Figure 1D:
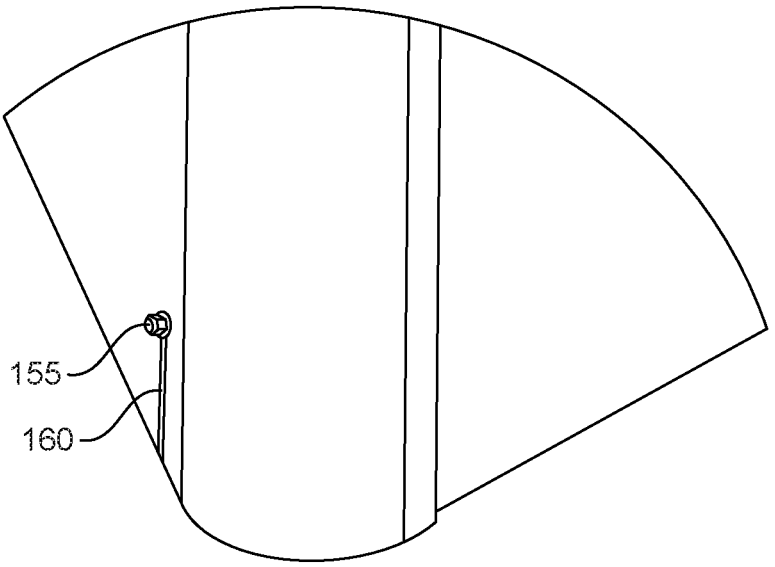

FIG. 1A is an illustration of a single display element 100 according to an embodiment and that can be used for supporting signage and as a component of a display structure. FIG. 1B illustrates the major components of display element 100 in a disassembled form. FIGS. 1C and 1D are detail views of regions C and D, respectively, from FIG. 1A.

With reference to these figures, display element 100 is comprised of separate and generally symmetric side panels 110, such as side panels 110*a*, 110*b*, and 110*c*, that are assembled in an overlapping manner and are connected to a base 105. Each side panel 110 has a respective top edge 115, a bottom edge 120, a side edge 125, and transition edge 130 adjacent a transition edge region 135, such as edges 115*a*, 120*a*, 125*a*, 130*a* and region 135*a* of panel 110*a*. In this embodiment, each panel is generally planar except at the transition edge region 135 which is curved at least in part along a radius parallel to the side and transition edges 125, 130. In alternative embodiments, the panel surface could be textured, such as with vertical or horizontal ridges or corrugations and the transition edge region could be more angled instead of curved.

Figure 1E:
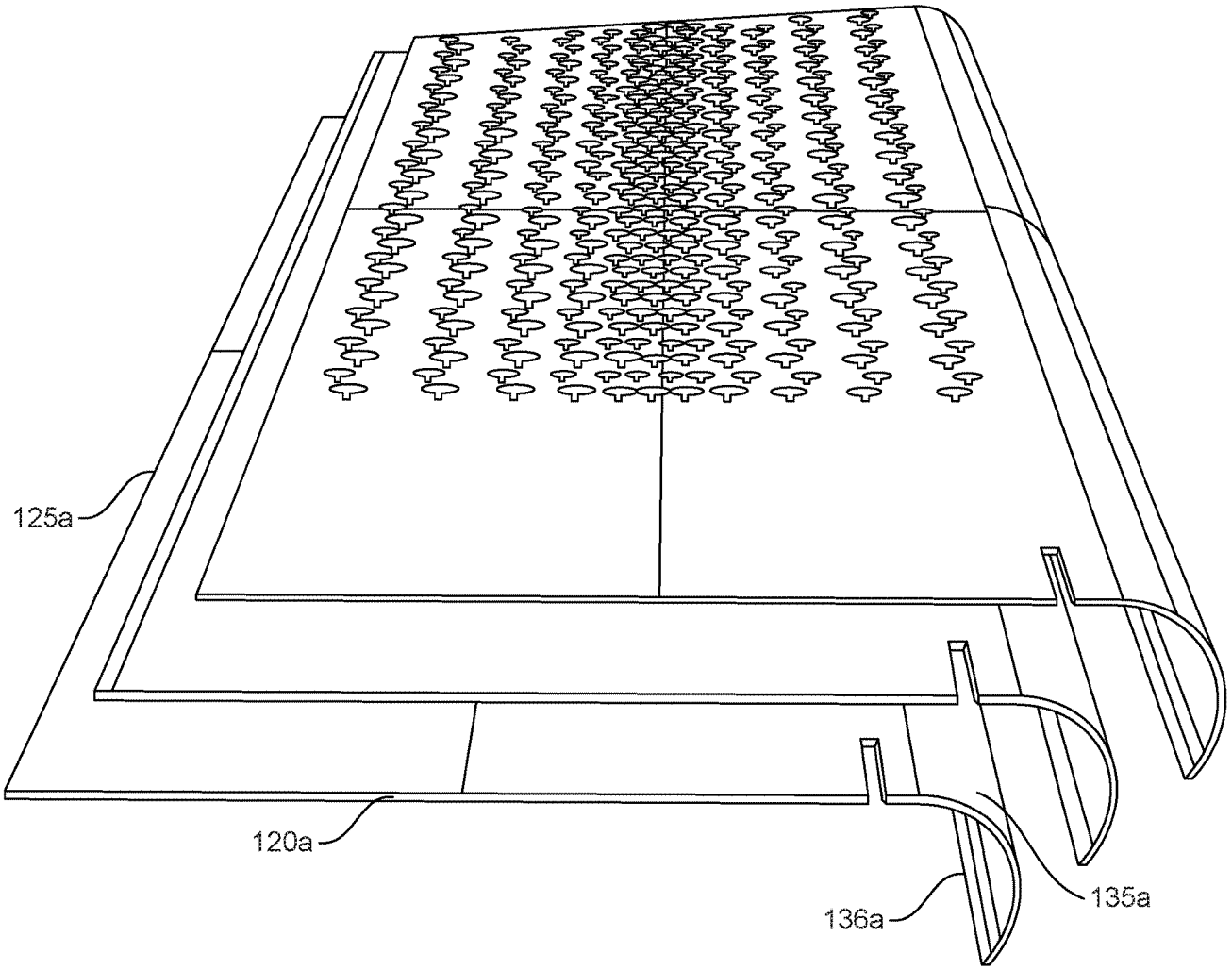

The side panels 110 and base 105 can be made of sheet metal, plastic, or other materials known to those of skill in the art. Different finishes can be applied to interior and exterior surfaces to provide a visually interesting effect. Triangular and other shaped display elements 100 can be fabricated to have sufficient strength for them to be used as structural support components in a multi display element structure as discussed further below. Unlike conventional truss exhibit systems, where the strut components are bulky to transport and store, the display elements 100 as disclosed can be easily disassembled and the side panels 110 of one or more display elements stacked together for easy transportation and storage, such as shown in FIG. 1E.

Each side panel has an array of mounting apertures 165 which can be used for supporting signage and for connecting other components to a display element 100. Various types of mounting hardware 175 known to those of skill in the art can be used to directly attach additional elements to a display element 100 or to attach alternative connection mechanisms, such as hook-and-loop connector pads, eyelets, hooks, or other fasteners. The particular mounting hardware 175 used can be selected based on the item to support and on the shape of the mounting apertures 165 among other factors.

The particular arrangement of apertures on a side panel 110 can be selected to provide both a wide variety of potential mounting locations but also to provide an interesting visual impact. Dense packing of large apertures allows air to more easily flow through the display element 100 making it less likely that the display element 100 will tip in a high wind situation. For example, in the area of the side panel with the mounting apertures, the apertures could reduce the wind-catching area of the panel by 30% or more depending on aperture configuration and density.

The apertures can be confined to a top area of the primary outer surface of a side panel 110 and a bottom area 170 can be aperture free. The vertical length of the top area can be 3 to 5 times the vertical length of the bottom area 170. This configuration can increase the strength of the side panel 110 in the area where it mounts to the base 105 and also provide an area to receive indicia or other signage expected to be more permanently present. There may also be a desire to obscure the inside portion of the display element 100 at the bottom to hide the base 105 and any weights or other items that may be placed thereon The mounting apertures 165 can be distributed randomly or in a pattern. In one configuration, the apertures are densely packed in rows and the placement of apertures on adjacent rows offset. The spacing in rows can be constant or variable, such as increasing towards the center of the panel so that apertures in the central area are overlapping. The size of the mounting apertures 165 can vary across the side panel 110. Differently sized apertures can alternate across a single row or each row can be the same sized.

In the embodiment illustrated in FIGS. 1A-1E, the mounting apertures 165 are generally circular shaped with a downward extending slot. The circular portions are provided in two different sizes having radius R1 and R2, with R1 being from about 25% to 75% of R2, although a greater or smaller size difference can be provided. Mounting hardware in the form of T-shaped peg can be fitted into the slot and hung therefrom. The mounting hardware can provide various fasteners to which signage can be attached such as hook-and-loop material, eyelets, and hooks.

In alternative embodiments, the mounting apertures 165 can be horizontal, vertical, or angled slots. The slot length can be varied to provide interesting visual effects while also providing increased flexibility for mounting elements to the display unit 100. For example, the mounting apertures 165 can comprise elongated vertical slots with lengths that are varied so that the relative proportions of the slots on a side panel 110 vary according to a Fibonacci pattern.

Figure 5A:
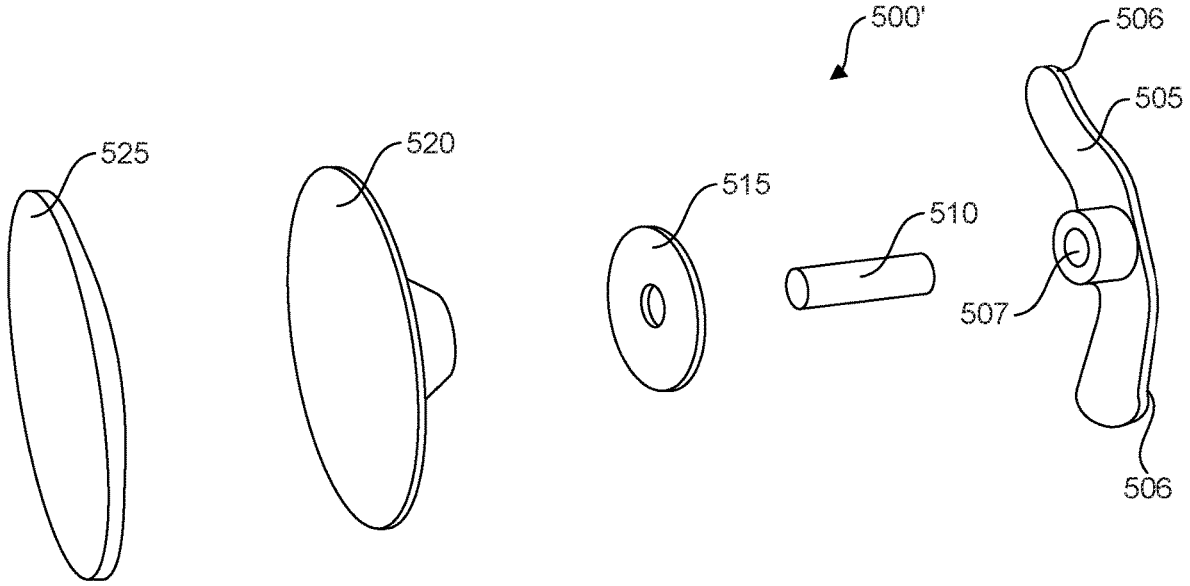
FIGS. 5A-5D illustrate particular mounting hardware and attachment to mounting apertures in a side wall of a display unit.
Figure 5B:
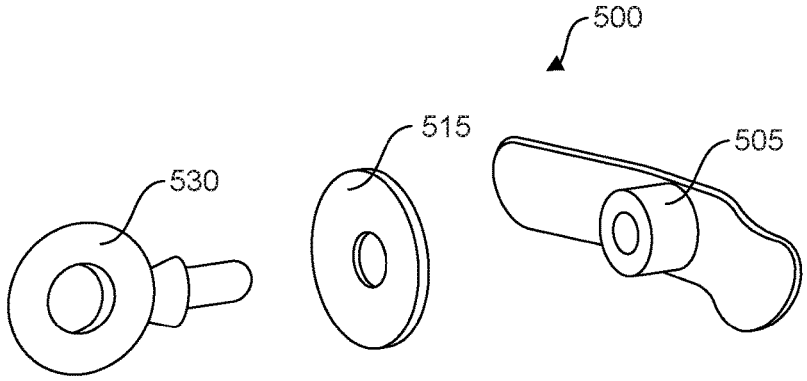
Figure 5C:
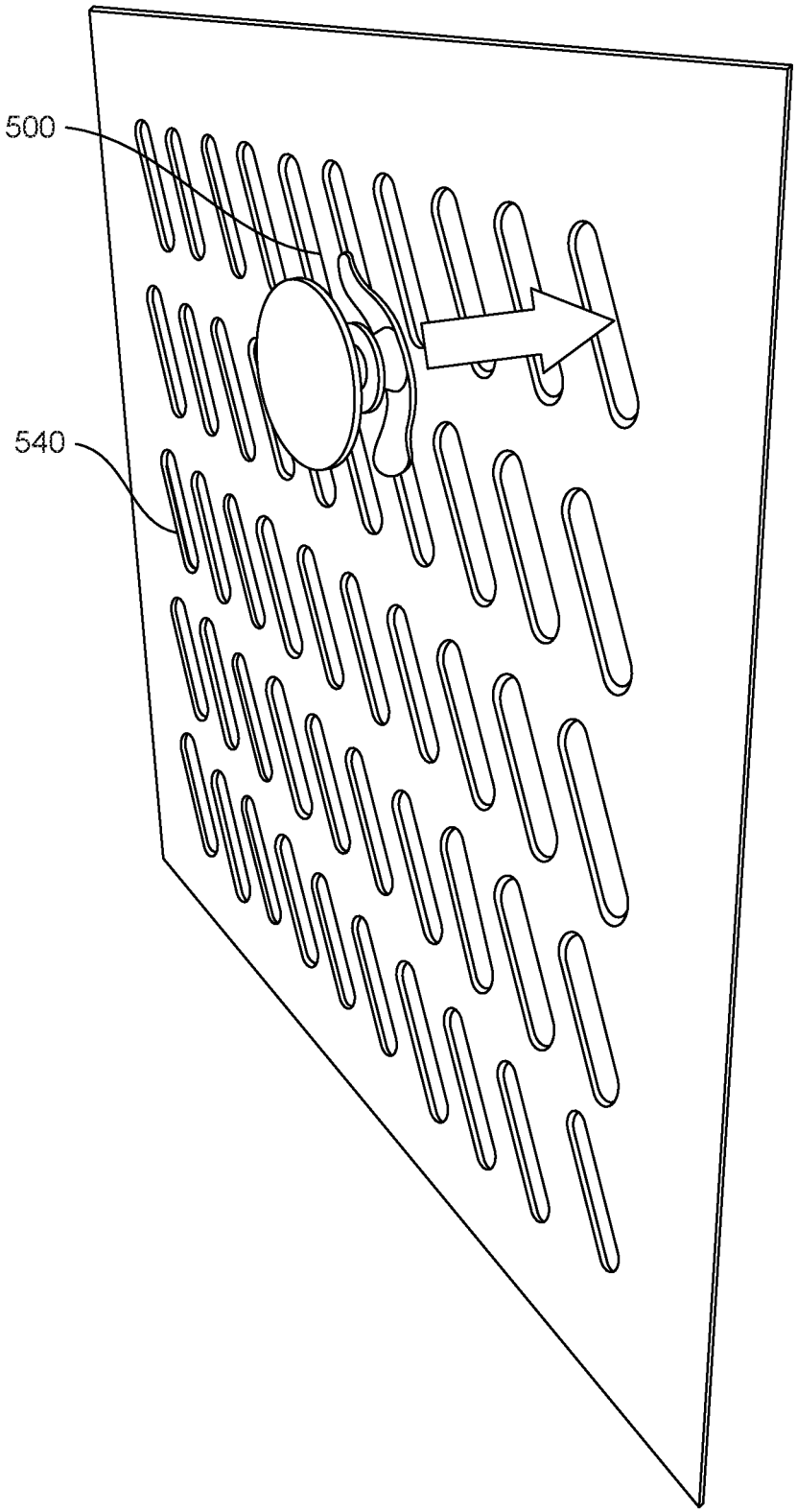
Figure 5D:
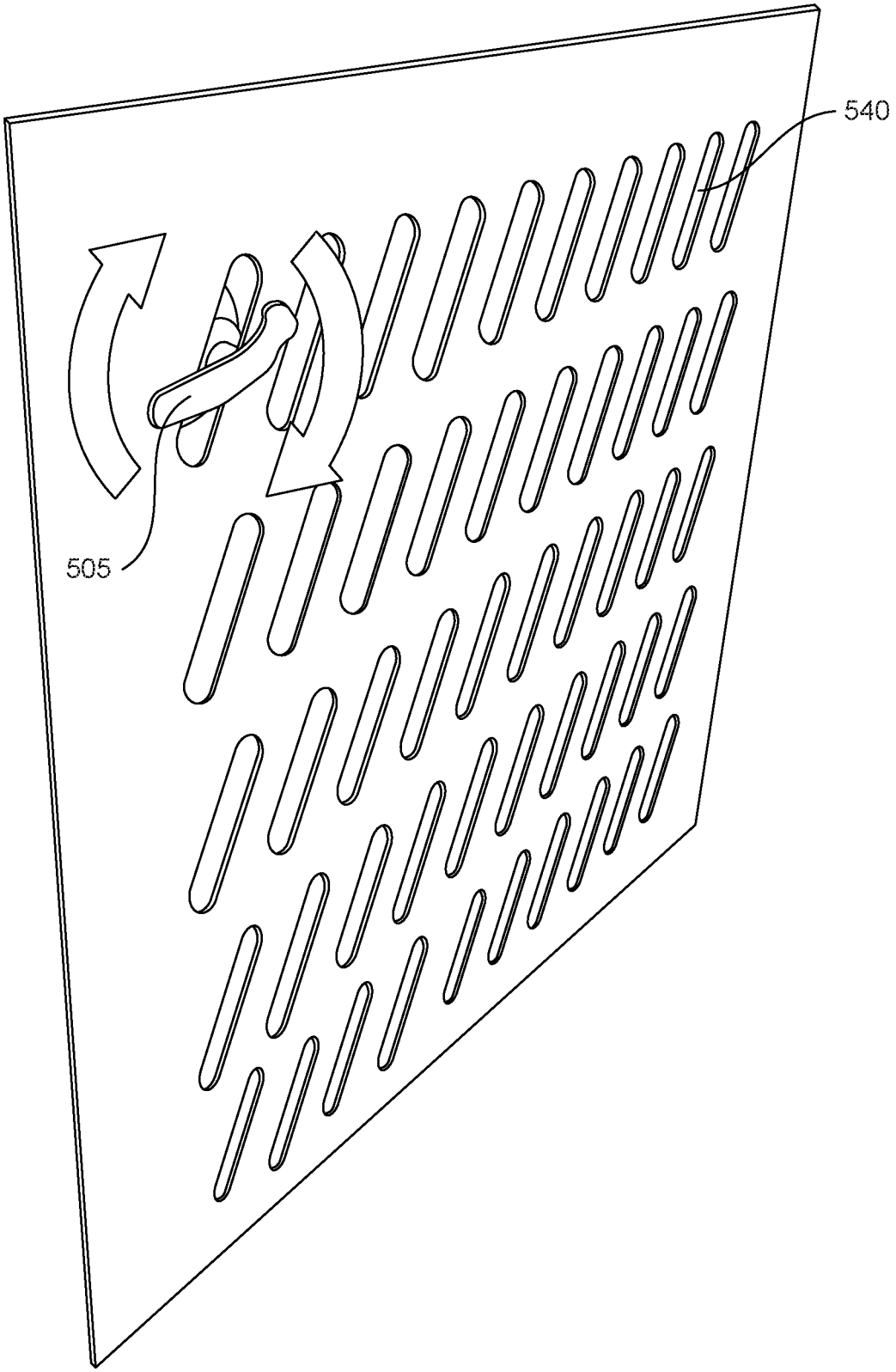

FIGS. 5A and 5B show mounting hardware 500 and 500' which is suitable for use with mounting apertures formed as elongated vertical slots, such as the angled slots 540 shown in FIGS. 5C and 5D. Mounting hardware 500 (FIG. 5A) comprises an end fitting 505 with a pair of opposed wings 506 extending from a central area with aperture 507 therein. A backer pad 520 connects to the end fitting 505 via a rod 510. A washer 515 can be placed between the backer pad 520 and end fitting 505. Hook-and-loop material 525 can be affixed to the backer pad. Mounting hardware 500' (FIG. 5B) comprises end fitting 505 to which an eyebolt 530 is attached with washer 515 in-between.

As shown in FIGS. 5C and 5D, mounting hardware 500 can be attached to a mounting aperture 540 by passing the end fitting 505 through the slot 540 and then rotating it to prevent removal. The components of the mounting hardware 500 can be mounted close enough to each other so that the end fitting 505 will ten to remain in the rotated position as shown in FIG. 5D due to friction. The hook-and-loop material 525 or eyebolt 530 provide an easy way to easily and removably attach signage and other components to the display element.

Returning to FIGS. 1A-1E, when the holder is assembled, the transition edge region 135 of one panel wraps over to cover the side edge 125 of the adjacent panel. The transition edge region 135 after the curved portion can continue as a flat surface 136 an additional distance before reaching the transition edge forming 130. The flat surface 136 will abut the front surface of the adjacent panel 110 when assembled. If the side panels 110 are not horizontal symmetric, different arc distances can be used. The overlapping regions of adjacent side panels 110 are affixed together, such as with fasteners 140. Each side panel 110 can also be coupled to a corresponding side of base 105. In the illustrated embodiment, each edge 145 of the base 105 has a respective upward extending flange 150 with a horizontally extending member 155 that fits into a corresponding slot 160 in the bottom edge 120 of the vertically adjacent side panel 110. In one embodiment, member 155 is a threaded screw and a bolt on the screw is used to secure the respective side panel 110 to the base 105.

To assemble the display element 100, the panels 110 are loosely fitted around the base 105 with the panels arranged in an overlapping manner as discussed above. The curved transition region 135 each side panel 110 helps the panel stand freely when loosely placed on the base and before it is secured in place. This makes it easier for a single person to assemble the display element.

Figure 2:
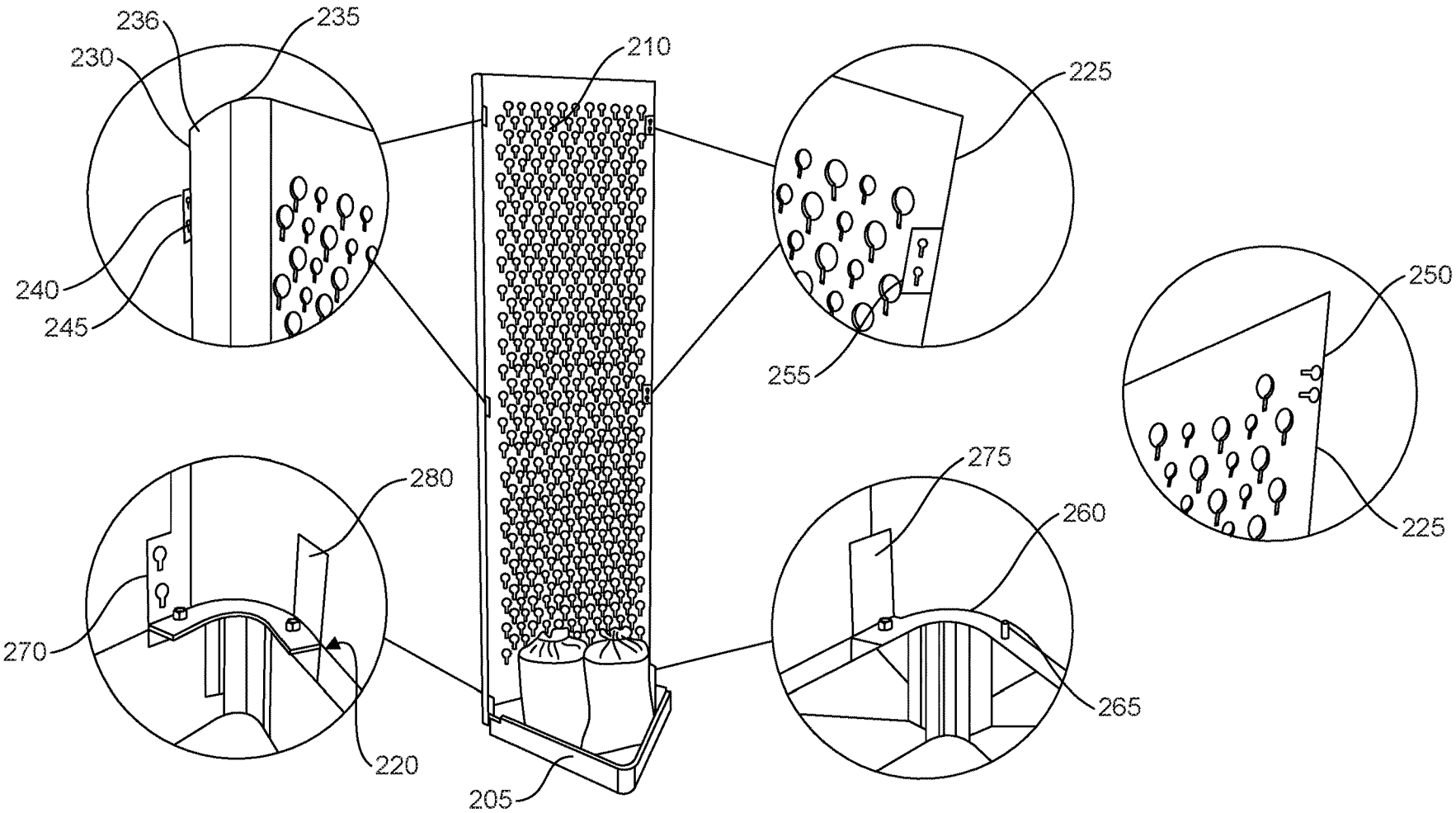
FIG. 2 shows alternative structures to connect the components of the display unit of FIGS. 1A-1E.

Alternative configurations can be used to allow easy connection of the side panels to each other and to the base without additional hardware. FIG. 2 shows a base 205 and side panel 210 having a side edge 225 and transition edge 230 adjacent transition region 235. One or more straight tabs 240 extend from the transition edge 230 and are generally parallel with the flat surface 236 at the end of transition region 235. The tabs 240 have keyhole apertures 245. Pins 250 are formed on the exterior surface of the panel 210 adjacent the side edge 225 and positioned so that they will mate with and lock into the keyhole apertures 245 of an adjacent panel during assembly. Similarly, one or more angled tabs can be provided on the side edge 225 and extend inward at an angle to allow for coupling with corresponding inward pins formed on an inside surface of an adjacent panel. To provide for coupling with the base 205, a plurality of upward pins 265 are provided along an upper edge or flange 260 of the base 205. Corresponding right-angle tabs, such as tabs 270, 275, 280 formed at the side edge 225, transition edge 230 and on the panel between the transition region 235 and side edge 225, are provided that extend inward from the bottom edge 220 of the panel. The horizontal portion of the tabs have an aperture to receive a respective upward pin and the components can be secured in place with a nut or other fastener.

The base 105, 205 can comprise just the vertical sides or alternatively have an interior horizontal surface which can be used, e.g., as a place for receiving weights (e.g., as shown in FIG. 2) to further stabilize the display element 100 during and after assembly.

In a particular configuration, each panel 110 is between 3 to 4 times higher than it is wide to provide a tall display element 110 that can be used for signs such as posters and elongated vertical banners as well as other displays. For example, the panels 110 can be from about 7 to 8 feet tall and from about 1¾ feet to 2⅔ feet wide. The transition edge region 135 can be curved over along an arc with a radius of about 6× to 12× the width of the panel 110 from the side edge 125 to the start of the transition edge region 135, or about 7× to 10× the width, or in a more particular configuration about 8.5× the width.

For a sign with a symmetric cross section, such as an equilateral triangle or square, the arc distance of the transition edge region 135 should be 360 degrees divided by the number of sides so that the end of the arc and the flat part 136 of the transition edge region 135 will be substantially parallel to the surface of the adjacent panel.

The side panels 110 can be configured so that they can be mounted together and to the base 105 in either a top-down configuration, where edge 120 is adjacent base 105, or a bottom-up configuration, where edge 115 is adjacent base 105. Allowing side panels 110 to couple to each other in two orientations allows for complexly shaped display assemblies 100 to be formed, with or without a base unit. For example, panels can be connected in alternating orientations to form a zig-zag shaped structure. For such a configuration, the arrangement of apertures on the panel can be symmetric top-to-bottom so that they are the same in either panel orientation. To be most easily used in this configuration, the side panels 110 are rectangular, although other shapes could be used as well.

The panels can have different heights and their respective top edges 115 need not be horizontal so to provide a visually interesting display element 100. For example, a first panel 110*a* can be about 7 feet tall with a horizontal top edge 115*a* while panels 110*b*, 110*c* have a rising top edges 115*b*, 115*c* with a panel height of about 7 feet on one side (such as to match adjacent top edge 115*a*) and about 8 feet on the other side to provide a beveled contour of the top edges 115*a*, 115*b*, and 115*c*.

Two or more separate holders can be combined to form a display system. The units can be placed so two corners are adjacent each other. A connection mechanism can be provided to attach the display units at the respective adjacent corners or the display units can be free standing. The display units can further be positioned so that sides panels of two display units are adjacent. A coupling passing through the apertures of adjacent sides can be used to easily secure the holders in place. The units can be arranged in a variety of open and closed shapes.

According to a further aspect of the system, multiple display units 100 can be combined and interconnected in a variety of ways and shapes to quickly and easily create temporary structures that are freestanding, lightweight, windproof, and stable. Example structures include a temporary exhibition area, kiosk, stage, and shelter.

Figure 3A:
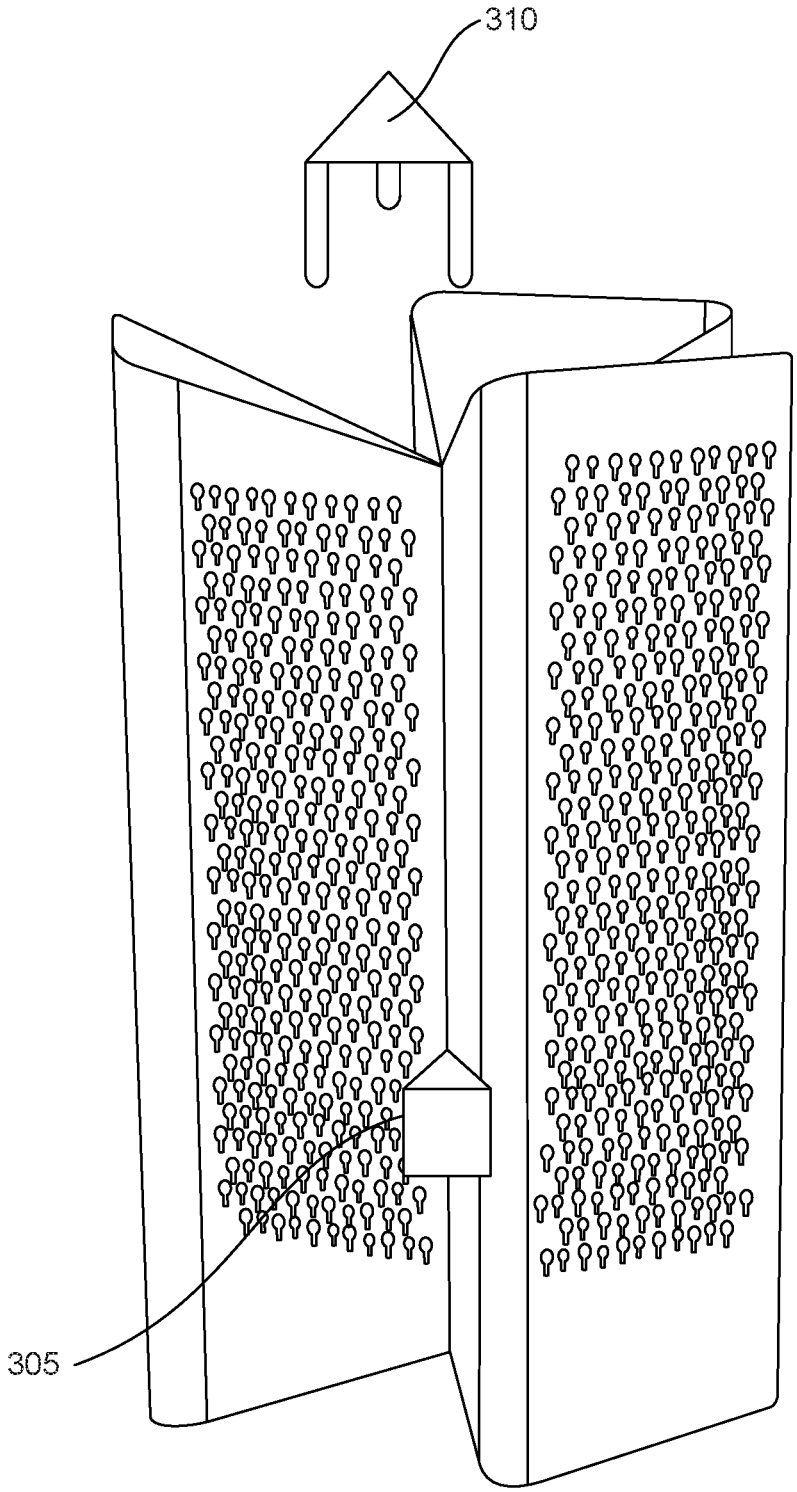
FIGS. 3A-3C show multiple display units ganged together in various configurations.
Figure 3B:
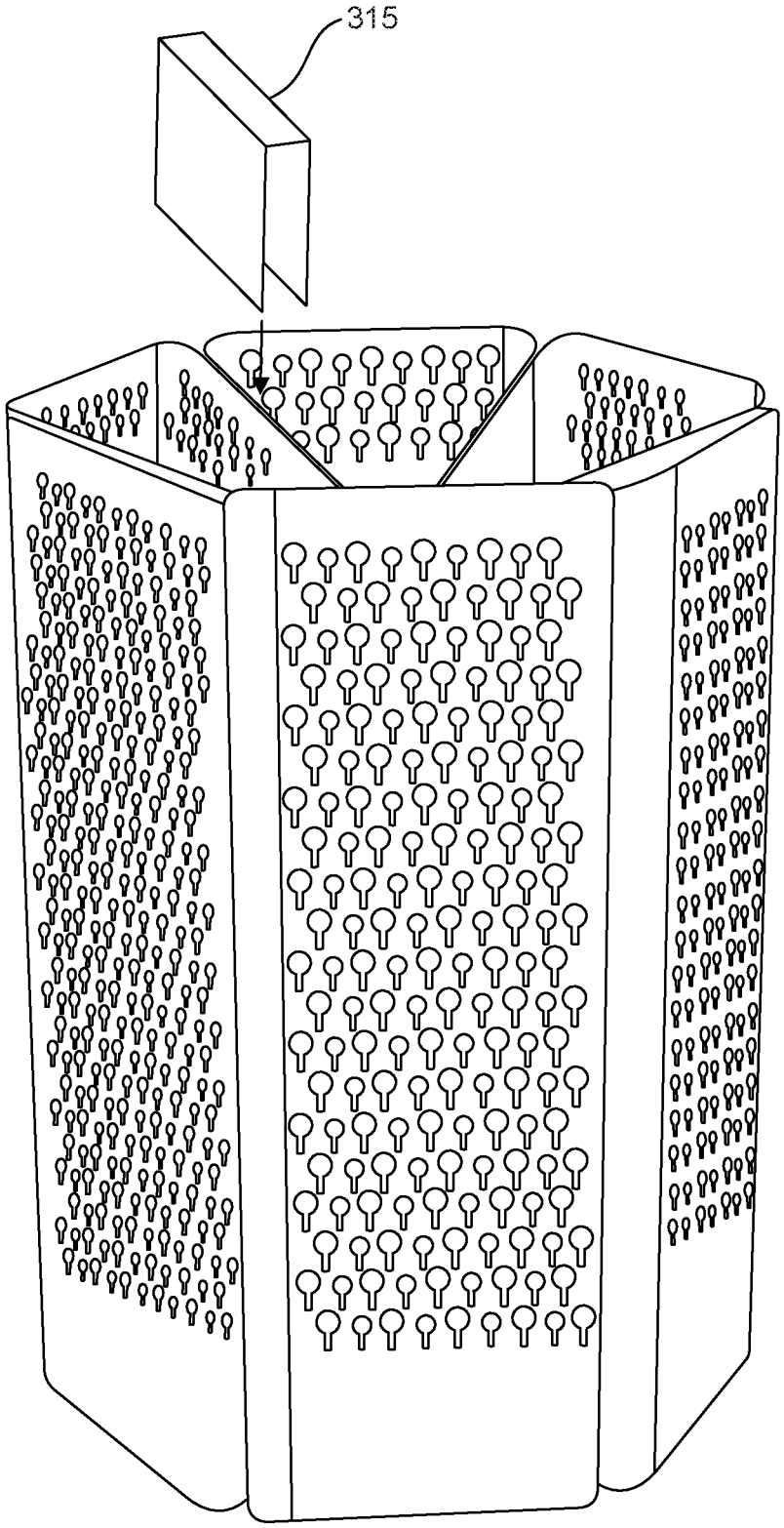
Figure 3C:
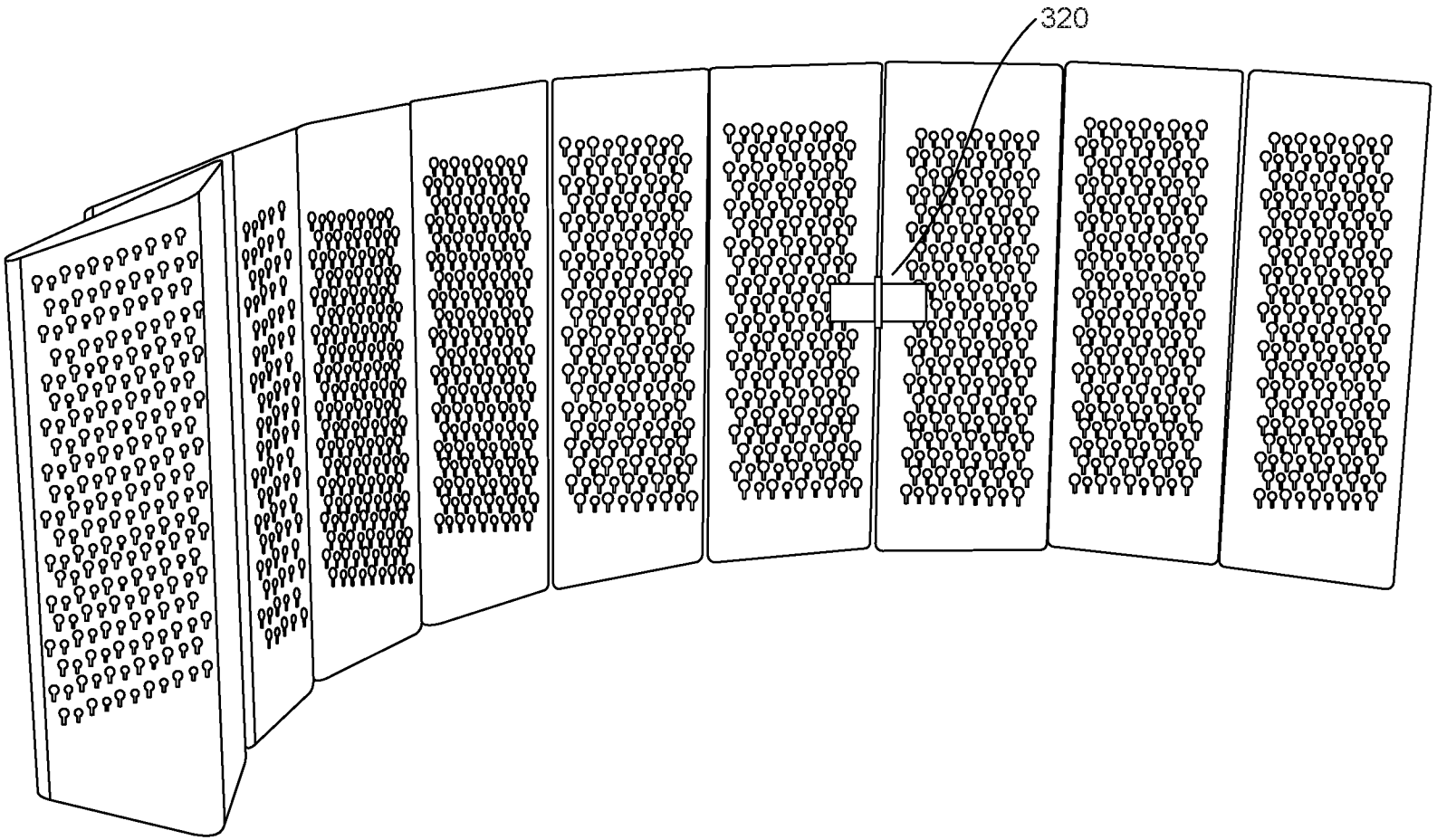

Several display units can be positioned next to each other along their edges to form a variety of open or closed structures, such as exhibition formations as shown in FIGS. 3A and 3B and a temporary backdrop or staging area, such as shown in FIG. 3C. The display units can be free standing or can be mechanically coupled to increase stability. Various coupling devices can be used singly or in combination, including a wedge 305 coupled to adjacent side panels of adjacent structures to maintain the units in a specified angular position, retaining prongs 310 put over adjacent corners to structurally link the units, and a U-shaped clip 315 placed over adjacent side panels. A hinged coupler 320 could also be used to allow display units 100 to be secured to each other in a variety of angular positions. Couplers that mount to an outward face of display units, such as couplers 305 and 320, are provided on their back with a suitably arranged mounting structure to allow easy connection to the mounting apertures on the display unit.

Figure 4A:
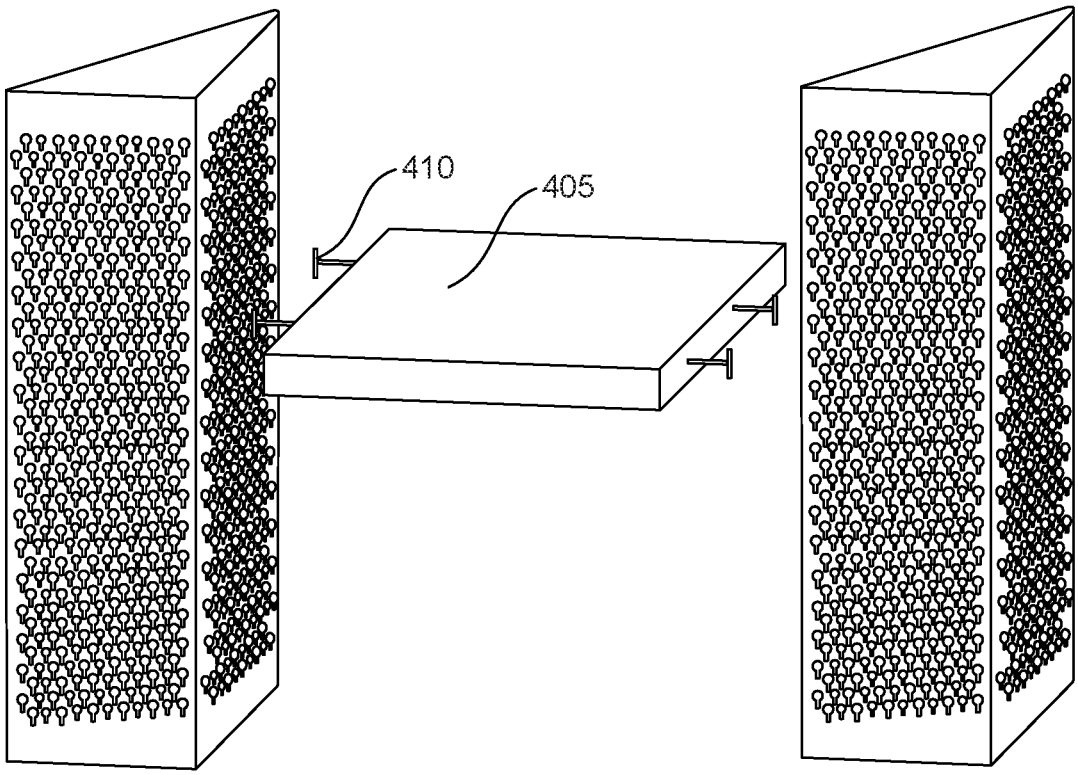
FIG. 4A-4C show multiple display units combined with removable shelving units in various configurations.

With reference to FIG. 4A, in a further configuration, a planar element 405, such as a shelf or panel (and generally referred to herein as a shelf) can be provided for attachment between a pair of display units 100. Separate shelves can be mounted on different sides of a display element 100 central holder and extend to surrounding other display elements 100. More than one shelf can placed between two holders. The display elements 100 combined with one or more shelves 405 allow for easy construction and disassembly of a variety of presentation spaces and structures. Shelves 405 can be used, for example, to display informational text and images, printed on a shelf, placed inside an appropriate holder formed on the shelf, or otherwise attached thereto. The shelving can also increase the rigidity of the combined structure.

The shelf 405 can have mounting hardware 410 on opposing sides to allow attachment to a side panel 110 of a display unit to thereby provide a highly modular and flexible display system. Mounting hardware 410 is configured as appropriate the mounting apertures in the display units and different shaped mounting apertures may require different mounting hardware. In a particular configuration, the positions of the mounting apertures on the display units 100 and the position of the mounting hardware 410 on the shelf are each configured so that the shelf 405 can be mounted to the side panels 110 in a variety of orientations from 0 to 90 degrees, such as horizontal, angled, or vertical.

The shelves can be easily mounted, removed, and adjusted in both height and angle as needed. Shelves can be mounted multiple sides of the display unit 100 and more than one shelf can be mounted between two adjacent display units 100 at the same or different angles. For example, a lower shelf can be mounted at or near 90 degrees and an upper shelf at around 45 degrees. Panels or flexible signage can be attached to one surface, to more than one surface, or may extend over several units either connected to or separate from each other.

Figure 4B:
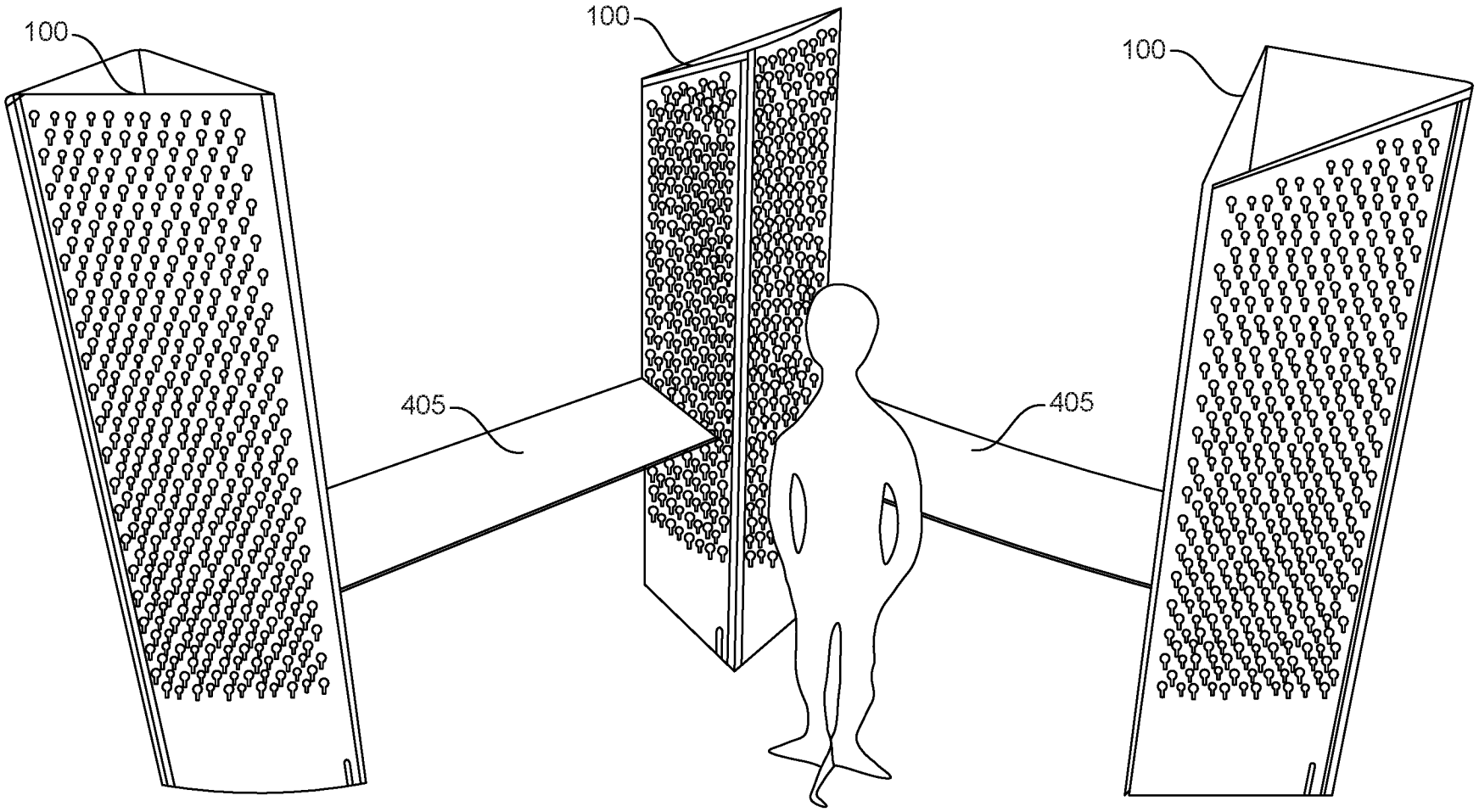
Figure 4C:
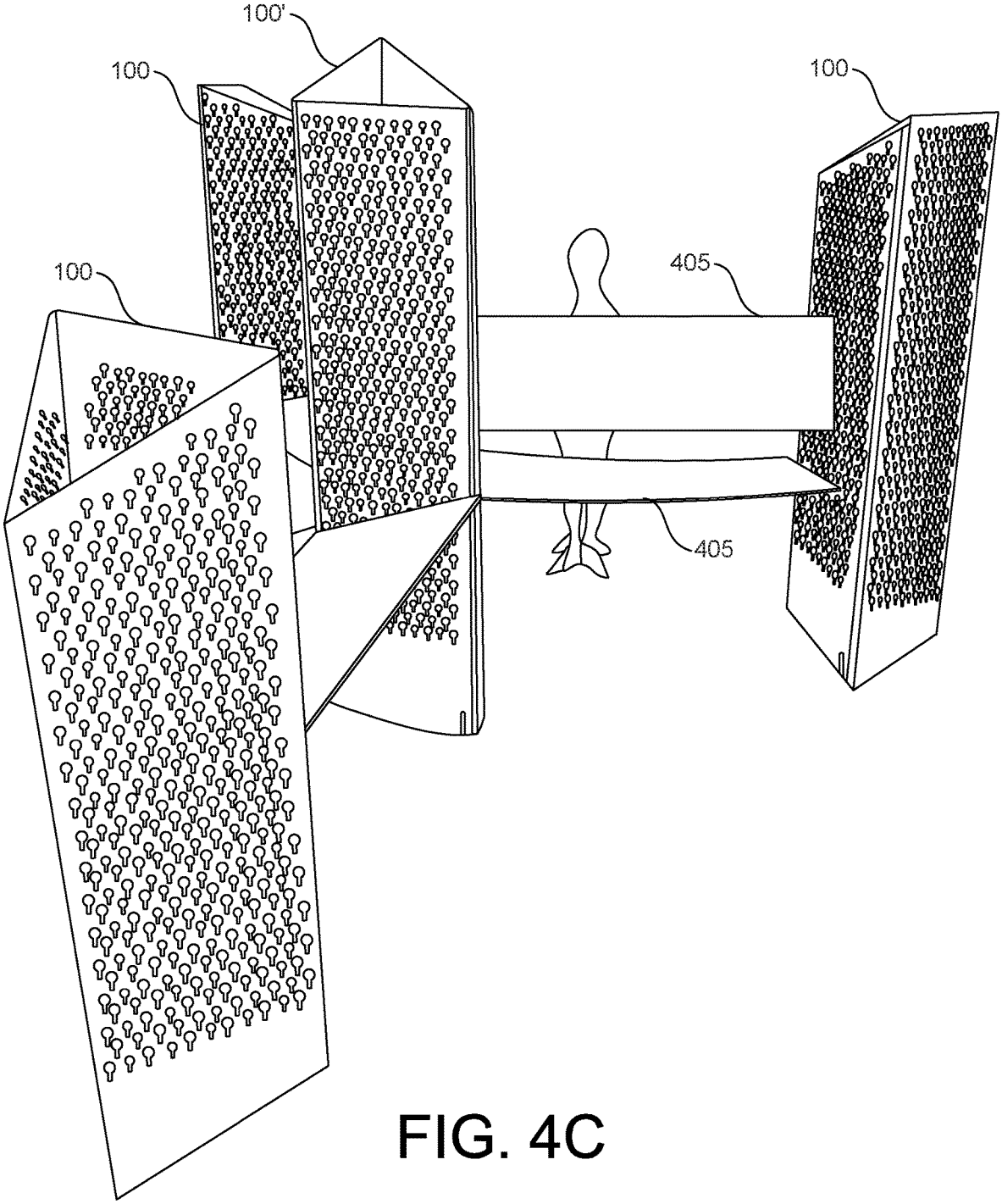

FIG. 4B shows an arrangement of three display units 100 interconnected with two shelves 405 to form a display area. FIG. 4C shows an arrangement of three display units 100 arranged in a hub-and-spoke configuration around a fourth central display unit 100'. that can be taller than the outer display units 100. FIG. 4C further illustrates the use of multiple shelves 405 between a pair of display elements In addition to shelves 405, a tensioned textile can be stretched between several display units across the top surfaces to create a covering over the area between the holders that can act as a sun or rain shield. A rigid cover could also be used. Textiles or panels can be attached to form walls for the kiosk.

Various aspects, embodiments, and examples of the invention have been disclosed and described herein. Modifications, additions and alterations may be made by one skilled in the art without departing from the spirit and scope of the invention as defined in the appended claims.

What is claimed is:

1. A display system comprising:

a plurality of vertical side panels and a base;

each respective side panel comprising:

a generally planar primary outer surface, top edge, a bottom edge, a first side edge, a second side edge parallel to the first side edge, and a transition region adjacent the second side edge and curved about an axis parallel to the second side edge, the primary outer surface having a plurality of mounting apertures formed therein;

the side panels arranged to form a closed geometric shape wherein the transition region of each respective side panel wraps around the first side edge of an adjacent side panel and is removably affixed thereto by at least one coupling assembly; and each respective side panel removably coupled at its bottom edge to a corresponding side of the base;

wherein the mounting apertures are configured to receive fasteners for affixing signage to the display structure;

the plurality of vertical side panels when decoupled from each other and the base can be stacked in a substantially flat arrangement.

2. The display system of claim 1, wherein the primary outer surface of each respective side panel having a first region extending downward from the top edge and a second region extending upwards from the bottom edge, the plurality of mounting apertures formed in the first region.

3. The display system of claim 2, wherein a vertical length of the first region is between 3 and 5 times the vertical length of the second region.

4. The display system of claim 1, wherein for each respective side panel the transition region is curved along an arc having a radius between 6× and 12× a width of the panel from the first side edge to the start of the transition region.

5. The display system of claim 1, the plurality of side panels comprising three side panels forming a generally triangular pillar.

6. A display system comprising:

a plurality of display elements each comprising three vertical side panels and a triangular base;

each respective side panel comprising:

a generally planar primary outer surface, top edge, a bottom edge, a first side edge, a second side edge parallel to the first side edge, and a transition region adjacent the second side edge and curved about an axis parallel to the second side edge, the primary outer surface having a plurality of mounting apertures formed therein each configured to receive and provide support for mounting hardware;

the side panels arranged to form a triangular pillar wherein the transition region of each respective side panel wraps around the first side edge of an adjacent side panel and is removably affixed thereto by at least one coupling assembly;

each respective side panel removably coupled at its bottom edge to a corresponding side of the base; wherein the plurality of vertical side panels when decoupled from each other and the base can be stacked in a substantially flat arrangement;

a generally rectangular shelf having first and second opposite edges with respective mounting hardware extending therefrom;

the mounting hardware on the first shelf edge removably attached to mounting apertures in a first side panel of a first display element, the mounting hardware on the second shelf edge removably attached to mounting apertures in a second side panel of a second display element.

7. The display system of claim 6, the mounting apertures in the first and second side panels positioned to permit the shelf to be mounted in a horizontal position, a vertical position, and at least one angled position between horizontal and vertical.

8. The display system of claim 6, wherein the primary outer surface of each respective side panel having a first region extending downward from the top edge and a second region extending upwards from the bottom edge, the plurality of mounting apertures formed in the first region.

9. The display system of claim 8, wherein a vertical length of the first region is between 3 and 5 times the vertical length of the second region.

10. The display system of claim 6, wherein for each respective side panel the transition region is curved along an arc having a radius between 6× and 12× a width of the panel from the first side edge to the start of the transition region.

11. A display system comprising:

at least one display pillar including a first display pillar;

each display pillar comprising:

a plurality of vertical side panels;

each respective side panel comprising:

a generally planar primary outer surface, top edge, a bottom edge, a first side edge, a second side edge parallel to the first side edge, and a transition region adjacent the second side edge and curved about an axis parallel to the second side edge, the primary outer surface having a plurality of mounting apertures formed therein;

the side panels arranged to form a closed geometric shape wherein the transition region of each respective side panel wraps around the first side edge of an adjacent side panel and is removably affixed thereto by at least one coupling assembly; and wherein the mounting apertures are configured to receive fasteners for affixing signage to the display structure and the plurality of vertical side panels when decoupled from each other can be stacked in a substantially flat arrangement.

12. The display system of claim 11, the first display pillar further comprising a base, each respective side panel of the first display pillar removably coupled at its bottom edge to a corresponding side of the base.

13. The display system of claim 11, the plurality of side panels of the first display pillar comprising three side panels forming a generally triangular pillar.

14. The display system of claim 11, wherein for the first display pillar the primary outer surface of each respective side panel having a first region extending downward from the top edge and a second region extending upwards from the bottom edge, the plurality of mounting apertures formed in the first region.

15. The display system of claim 14, wherein for the first display pillar a vertical length of the first region is between 3 and 5 times the vertical length of the second region.

16. The display system of claim 11, wherein for each respective side panel of the first respective display pillar the transition region is curved along an arc having a radius between 6× and 12× a width of the panel from the first side edge to the start of the transition region.

17. The system of claim 11, further comprising:

a second display pillar;

a shelf having first and second opposite edges with respective mounting hardware extending therefrom;

the mounting hardware on the first shelf edge removably attached to mounting apertures in a side panel of the first pillar; and the mounting hardware on the second shelf edge removably attached to mounting apertures in a side panel of the second pillar.

18. The system of claim 17, wherein the shelf is generally rectangular.

19. The system of claim 17, the mounting apertures in the respective side panels of the first and second pillar positioned to permit the shelf to be mounted between the first and second pillars in a horizontal position, a vertical position, and at least one angled position between horizontal and vertical.

* * * * *